US005284609A

United States Patent [19]

Avenne

[11] Patent Number: 5,284,609

[45] Date of Patent: Feb. 8, 1994

[54] METHOD AND APPARATUS FOR THE MANUFACTURE OF WOOD CHIP BOARDS AND SIMILAR BOARD MATERIALS

[75] Inventor: André V. Avenne, Oostrozebeke, Fed. Rep. of Germany

[73] Assignee: Eduard Küsters Maschinenfabrik GmbH & Co Kg, Krefeld, Belgium

[21] Appl. No.: 654,604

[22] PCT Filed: Feb. 9, 1990

[86] PCT No.: PCT/EP90/00206

§ 371 Date: Jun. 17, 1992

§ 102(e) Date: Jun. 17, 1992

[87] PCT Pub. No.: WO90/09263

PCT Pub. Date: Aug. 23, 1990

[30] Foreign Application Priority Data

Feb. 18, 1989 [DE] Fed. Rep. of Germany ..... 3904982

[51] Int. Cl.[5] ..... B27N 3/24; B30B 3/06

[52] U.S. Cl. ..... 264/101; 264/109; 425/371

[58] Field of Search ..... 264/109, 101; 425/371

[56] References Cited

U.S. PATENT DOCUMENTS

| | | | |
|---|---|---|---|
| 3,926,542 | 12/1975 | Ahrweiler | 425/174.4 |
| 3,993,426 | 11/1976 | Ahrweiler | 425/371 |
| 4,213,748 | 7/1980 | Ahrweiler | 425/371 |
| 5,085,812 | 2/1992 | Ahrweiler et al. | 264/37 |

FOREIGN PATENT DOCUMENTS

| | | |
|---|---|---|
| 1199974 | 9/1965 | Fed. Rep. of Germany . |
| 1216531 | 5/1966 | Fed. Rep. of Germany . |
| 2243465 | 11/1979 | Fed. Rep. of Germany . |
| 2355797 | 4/1981 | Fed. Rep. of Germany . |
| 2819943 | 12/1984 | Fed. Rep. of Germany . |
| 3704940 | 8/1988 | Fed. Rep. of Germany . |
| 3904982 | 2/1990 | Fed. Rep. of Germany . |

*Primary Examiner*—Mary Lynn Theisen

*Attorney, Agent, or Firm*—Kenyon & Kenyon

[57] ABSTRACT

In a double-belt press used to produce wood chip boards and the like, narrow edge strips of the filling are vacuumed off at the edge (32) of the filling (33) producing the boards (33), leaving tabs (37) in place. (FIG. 5 ).

9 Claims, 2 Drawing Sheets

METHOD AND APPARATUS FOR THE MANUFACTURE OF WOOD CHIP BOARDS AND SIMILAR BOARD MATERIALS

BACKGROUND OF THE INVENTION

The invention relates to a process of the type for producing on a continuous basis boards made of wood chips or other particles, in which the particles are bonded together and hardened under the application of pressure and heat, as well as to a corresponding apparatus, as are known from the German Patent 23 55 797.

An apparatus of this type represents a considerable investment and, therefore, the operators have the desire not only to be able to produce boards with widths corresponding to the nominal working width on such an apparatus, but also, if needed, narrower boards. For example, boards widths of 210 and 185 cm are conventional on the market. Problems occurred previously when the attempt was made to run the narrower board on an apparatus designed for the wider board by adjusting the width of the filling to be correspondingly narrower, because the edges of the forming belts projecting beyond the edge of the filling were no longer subjected to a counter-pressure and were no longer adequately pressed against the support structure, from which not only the pressure, but also the heat, is transferred to the forming belts. Therefore, the forming belts no longer had any thermal contact at the edge with the support structure or with the rollers in the case of the construction disclosed in the German Patent 23 55 797, which rollers transmit the heat from the support structure to the forming belts and roll over the entire width of the forming belts, so that the temperature of the forming belts dropped significantly toward the edge. As a result, the edge zones shrank lengthwise and considerable thermal stresses developed since the wide middle zone of the forming belts was at working temperature. Such thermal stresses became critical in the area of the reversing drums because there the thermal stresses combined with the stresses being added by the significant longitudinal tension of the forming belts and by the elongation of the outer fibers due to the rerouting of the belts. As a result, total tensile stresses developed on the outside of the areas of the forming belts guided over the reversing drums. These stresses approached, and sometimes exceeded, the yield stress. In any case, however, they led to problems during continuous operation, especially as the forming belts are made of stainless steel, which is not particularly resistant to lasting bending strains.

Similar problems already occurred even earlier in double-belt presses, and in fact even when running with the nominal width. The filling, namely, does not extend exactly up to the edge of the forming belts. Rather, these forming belts projected transversely by a certain amount beyond the filling and also beyond the edge of the zone covered by the rollers. Here again, there were temperature drops and associated thermal stresses.

In the case of the press according to the German Patent 22 43 465, an attempt was made to keep the temperature drop within limits by heating the projecting edges of the forming belts. However, it was found to be necessary to heat the edges of the forming belts over practically their entire length, because otherwise the temperature immediately dropped off outside of a heated spot. However, heating the entire length of the forming belts entails significant structural problems and generally does not come under consideration due to the considerable expense.

According to the German Patent 28 19 943, another solution is found by corrugating the projecting edge of the forming belts, so that in case of a temperature drop toward the edge, more material is available there to an extent, and so that the longitudinal tensile stresses which occur in case of a thermal contraction are not so great. To be sure, this measure is practicable for edges projecting by a few centimeters, however no longer when these edges, in which a temperature drop is to be noted, amount to several tens of centimeters.

A solution to the problem is known from the German Published Patent Application 37 04 940, in which an edge filling of unbonded particles is spread on to the bottom forming belt and pressed with it in the edge zone extending outside of at least one edge of the filling producing the boards up to close to the edge there of the compression section. To be sure, excellent results are obtained with this method. However, the expenditure for additional spreading equipment and the subsequently added return systems for the spread, unbonded particles at the end of the compression section is considerable.

The object of the invention is to develop this type of process and such an apparatus so that a contact arrangement of the forming belts at the roller chains which ensures adequate thermal transfer to the forming belts at the edge can be achieved with minimal expenditure for equipment.

SUMMARY OF THE INVENTION

The present invention meets this and other objectives by providing a process and apparatus for the continuous production of boards made of wood-chips or other particulate material. These chips or particles are bonded together with a bonding agent that is hardened under the application of heat and pressure in a double-belt press in which the particles and bonding agent are scattered along a horizontal portion of a lower forming belt to form a filling. This mixture is then hardened in a compression section that is situated between lower and upper metal forming belts. These belts are also wrapped around in the forward direction of the double-belt press so as to form a web during the process. The operating heat and pressure are transferred from the supporting structure of the double belt press to the forming belts, and thence to the filling. At least one edge of the filling which results in the web of the board material has a narrow edge strip of filling that is vacuumed off in such a manner as to leave the tabs in place.

Unexpectedly, the tabs that remain between the sections of the edge strips that have been vacuumed off hold the forming belts in their vicinity in contact with the roller chains in a way that ensures adequate thermal transfer, and the dish-shaped deformation of the forming belts, caused by uneven temperature distribution, is kept within limits that are acceptable in practice. Also, due to the contact arrangement of the forming belts in the outer areas, lubricants are prevented from being baked on to the rolling surfaces of the rollers there and the lubrication of the rollers is maintained.

Another aspect consists in that the spreading width actually used can be adapted to the utilized board web width without having to adjust the working width of the spreading machine, which can be extremely costly, and without having to saw off wide and continuous edge strips from the finished boards.

The expense for a vacuum system used at the edge of the filling is less than that for a spreading system, for instance, according to the German Published Patent Application 37 04 940. Compared to the alternative of simply running the board web at its complete width and then sawing off a correspondingly wide and continuous edge strip, a simplification and greater cost savings likewise result because it is much easier to dispose of the not yet unbonded chip material than it is to dispose of an edge strip that has already been hardened to form a board and, therefore, first has to be cut into smaller pieces and, in addition, because the chips that are vacuumed off and are not yet unbonded can be returned to the spreading equipment.

The edge strips that are vacuumed off should be "narrow". What is meant is that, if the board web is on the order of 2 m wide, the edge-strip section can be, for example, 2 to 30 cm wide. The longitudinal length of the tabs can be from approximately 2 to 20 cm, whereby it is recommended that this length should preferably be no greater than the length of the edge-strip sections that are vacuumed off, because otherwise the simplification effect will not be sufficiently noticeable.

In particular, the ratio of the length of the vacuumed off edge-strip sections to that of the tabs can amount more or less to 3:1 up to 15:1, whereby the length of the edge-strip sections that are vacuumed off lies in the range of about 30 to 100 cm.

The invention also encompasses an apparatus for the continuous production of such wood-boards that utilizes an intermittently operating vacuum system to vacuum off the desired narrow edge-strip sections of the fillings.

A specific embodiment invention is depicted in the drawing.

DETAILED DESCRIPTION

Figure 1:
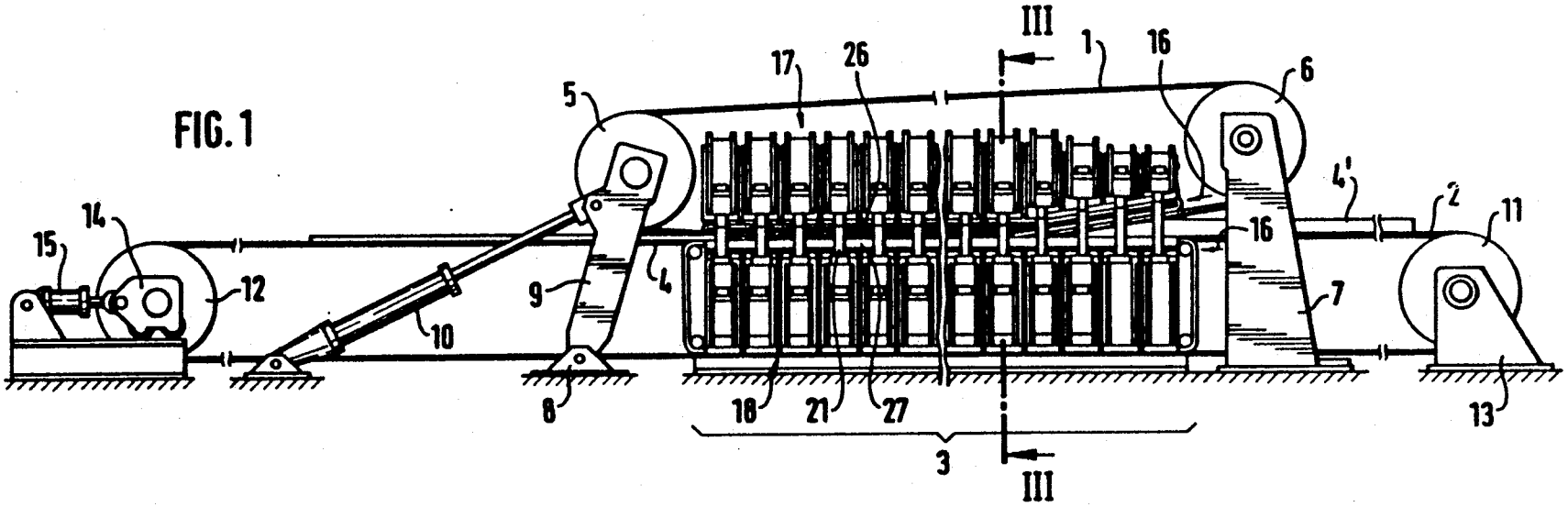
FIG. 1 is a side view of a double-belt press, on which the invention can be applied.

FIG. 1 shows a double-belt press for manufacturing wood chip boards, wood fiber boards, and other materials in board form, which consist of particles bonded by a binding agent that hardens under pressure and heat. It comprises a top forming belt 1 made of sheet steel of a thickness of about 1 to 1.5 mm, and a similar bottom forming belt 2. A web 4 of a filling 4', which consists of a pourable material that results after the compression in one of the above mentioned materials, is compressed between the forming belts 1, 2 in a compression section 3.

The top forming belt 1 revolves around rollers or drums 5, 6 disposed transversely of the web 4, of which the drum 6 is mounted in a stationary stand 7, drum 5 is supported in a stand 9 that is pivotable about a bearing member 8 at the ground around an axis running transversely of the web 4. The stand 9 is moved by means of hydraulic cylinders 10 and, in this manner, the forming belt 1 is tightened.

The forming belt 2 revolves in a corresponding manner around drums 11, 12 disposed transversely of the web 4, of which the drum 11 is mounted in a stationary stand 13, while the drum 12 is mounted in a stand 14 that can be moved on rails. The stand 14 can be moved in the longitudinal direction relative to the web by hydraulic cylinders 15, and the forming belt 2 can be tightened in this manner. The forming belts are driven by the drums.

The forming belts 1, 2 run through the apparatus in the direction indicated by the arrows 16, so that the filling 4', which is applied on the right-hand side according to FIG. 1 by means not shown, is drawn into the compression section 3. The compressed web 4 that emerges is removed in the left-hand area according to FIG. 1 of the forming belt 2 by suitable devices that are not shown. A top support structure 17 is provided in the compression section 3 within the inner region of the forming belt 1 and it interacts with a bottom support structure 18 that is provided in the inner region of the bottom forming belt 2. The support structures 17 and 18 brace the areas of the forming belts 1, 2 that face the web 4 against the web and press them flat against each other with considerable force.

Figure 2:
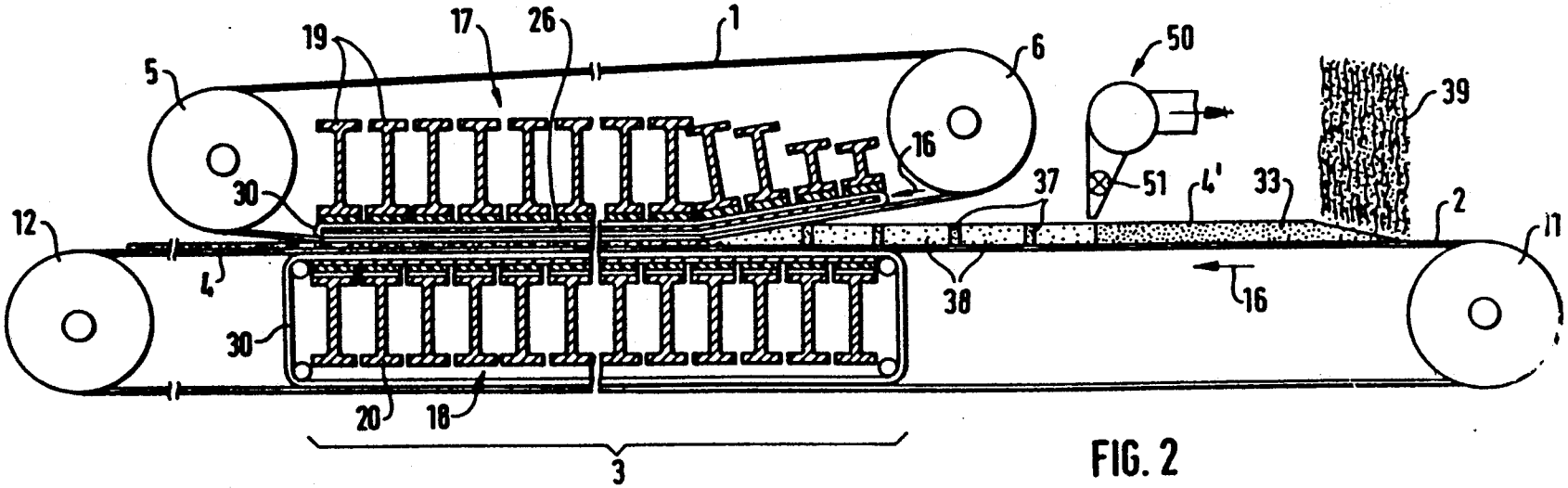
FIG. 2 is a vertical longitudinal section through the double-belt press taken along the line II—II in FIG. 3.
Figure 3:
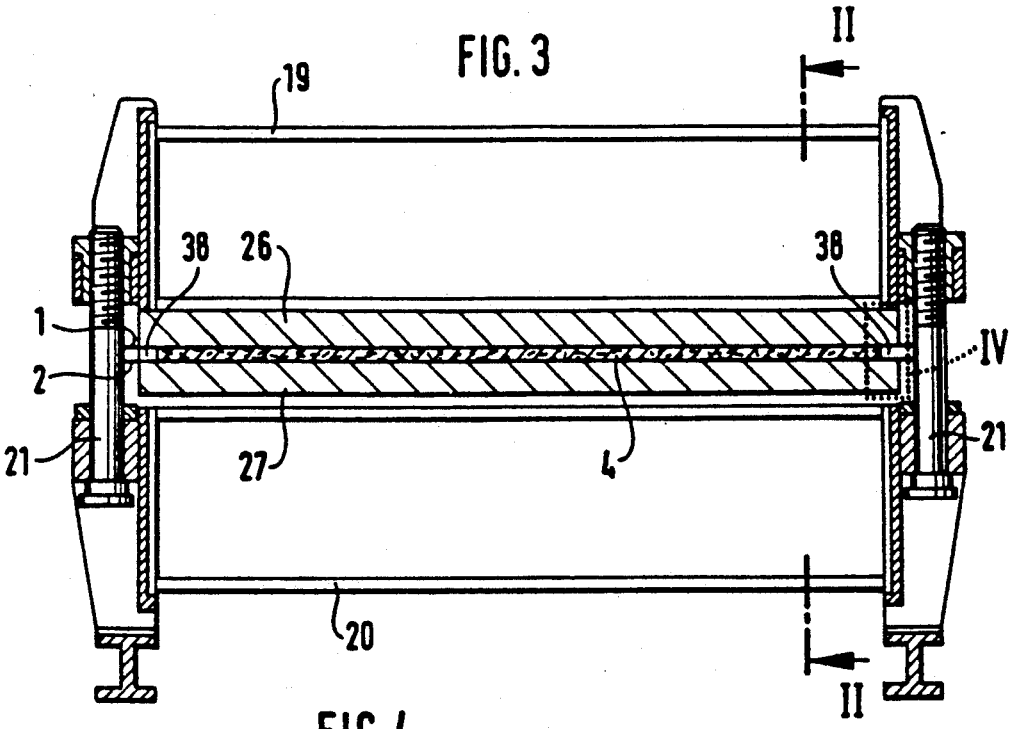
FIG. 3 is a cross-section through the double-belt press taken along the line III—III in FIG. 1.

The support structures 17, 18 consist in each case of individual carriers 19, 20, which are each disposed opposite one another above and below the forming belts 1, 2 and the web 4 (FIG. 2). Each carrier pair 19, 20 is clamped together by lateral spindles 21 (FIG. 3), so that individual pressure elements are formed that are self-contained in terms of force.

Thick plates 26, 27 are disposed between the carriers 19, 20 and the forming belts 1, 2 that transfer the force exerted by the individual carriers 19, 20 on an even plane to the forming belts 1, 2 and that contain ducts 40 (FIG. 4) in which heater elements are disposed or through which a heating medium is passed.

Roller chains 30 are disposed between the sides of the plates 26, 27 facing each other and the forming belts 1, 2 The forming belts 1, 2 roll off these roller chains 30 opposite the plates 26, 27. The roller chains 30 continuously revolve in a vertical longitudinal plane around the plates 26 and 27. The rollers of the roller chains 30 transmit both the pressure as well as the heat from the plates 26, 27 to the forming belts 1,2, and thus to the web 4 that is being formed.

Figure 4:
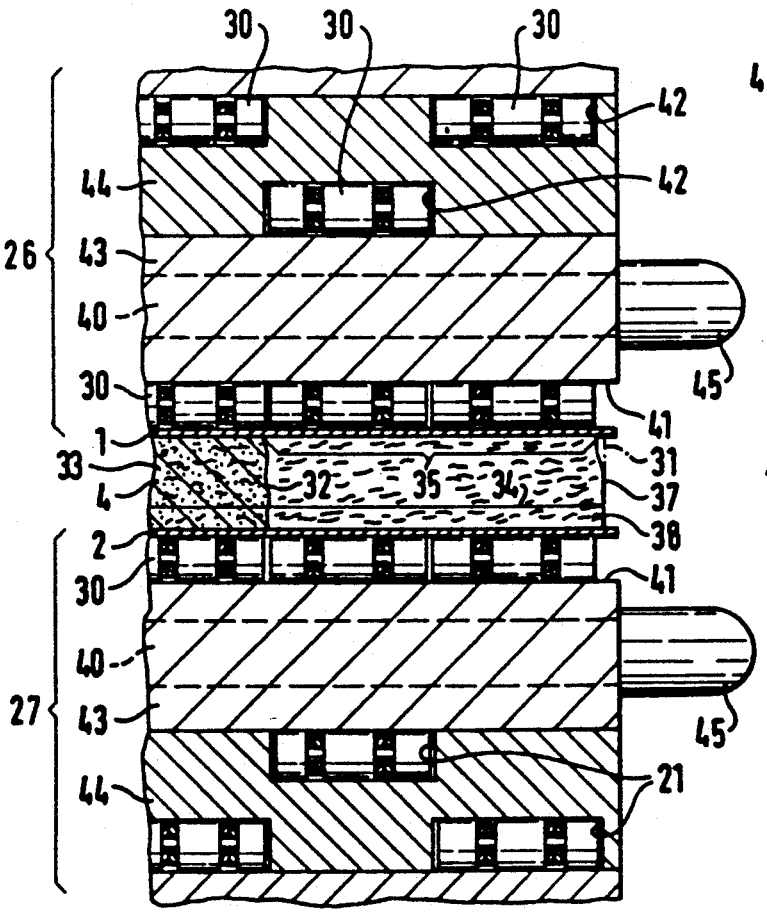
FIG. 4 is a partial cross-section through the edge zone IV in FIG. 3, which is shown as the area enclosed by dashed lines.

Once a given point of the roller chains 30 has arrived at the end of the longitudinal section 3, the roller chains 30 can be fed back in the actual pressing zone, i.e. between the carriers 19, 20 and the plates 26, 27, as shown in FIG. 2 in the case of the plates 26, and in FIG. 4. This design advantageously allows the roller chains 30 to maintain a substantially constant temperature as they revolve. As an alternative design, the roller chains 30 can be externally guided around the support structure as seen at the bottom of FIG. 2, in the case of the support structure 18.

Referring to FIG. 4, the plates 26, 27 are constructed of a heating and support plate 43 and a separate return plate 44 that has return grooves 42 for the roller chains 30.

It is a question of a partial cross-section through an edge zone which is located above the web 4 with respect to FIG. 2.

The plates 43 have heating ducts 40, which are interconnected at the ends by way of pipe elbows 45 to form a closed pathway. The plates 43 also have smooth bearing surfaces 41, which form the common rolling surfaces for the roller chains 30 disposed side by side, which can be recognized in FIG. 4.

When the forming belts 1, 2 move forward, the roller chains 30 roll off between them and the bearing surfaces 41 of the plates 43. Adjacent roller chains 30 are situated thereby with their outer end faces directly opposite one another.

An essential point with regard to the chain arrangement is that each pair of adjacent roller chains 30 is capable of moving forward independently of one another. The totality of the support elements for the forming belts 1, 2 forms a bay that is divided longitudinally into individual lengths, which can move back-to-back [against one another] in the longitudinal direction when stressed accordingly. Thus, no constraining forces resulting from the slaving action of the forming belts can build up within the roller chain arrangement.

When the depicted double-belt press is driven on with the full working width 34, the right-hand edge 31 of the filling and of the board web 4 as seen in FIG. 4 is located more or less at the height of the right-hand edge of the roller chains 30. However, it may now be desired to manufacture a narrower board web on the same press, with the right-hand edge 32 of the board web, as seen in FIG. 4, located within the rolling area of the roller chains 30.

A filling 33 of wood chips or other appropriate particles is then applied in the usual manner to the forming belt 2, whose width corresponds to the nominal working width 34 and is characterized by the position of the edge 31 in FIG. 4. These wood chips or other particles are provided with a bonding agent, as indicated by the dots drawn in the dropping zone 39 in FIG. 2.

Figure 5:
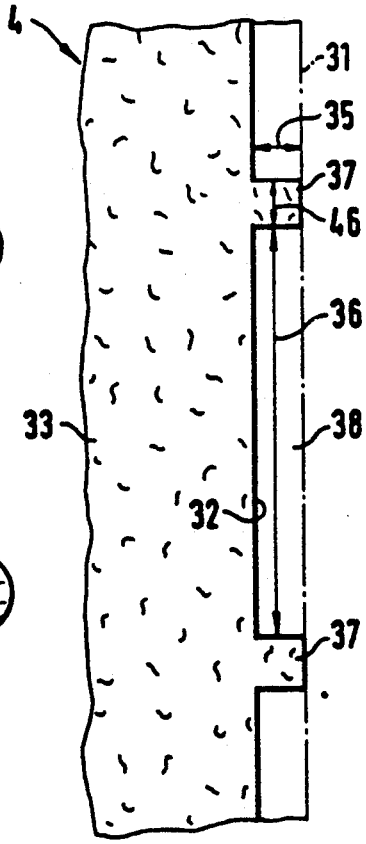
FIG. 5 is a partial, reduced scale top view of the edge zone of a web of a wood-fiber board shown in FIG. 4.

At both edges of the filling 33, before the point where it enters between the forming belts 1,2, a vacuum removal system 50 is arranged, by means of which edge strips 38 (see FIG. 5) of the filling 33 can be vacuumed off intermittently by operating the valve 51 appropriately, so that the filling 33 is "stripped" to an extent at the edge. The length of the vacuumed of edge-strip sections 38 is designated in FIG. 5 by 36, and its width from the edge 31 that corresponds to the maximum working width up to the edge 32 representing the actual limitation of the specific working width is designated by 35. Between the vacuumed off edge sections 38, tabs 37 are left in place, in which the filling 33 remains to the full working width 34, as shown in FIGS. 4 and 5, as far as the edge 31. The length of the tabs 37 in the longitudinal direction of the web 4 is designated by 46. In the vicinity of the width 35 of the tabs 37, the forming belts 1,2 are braced in the manner as is apparent from FIG. 4 and pressed against the roller chains 30,30. In the vicinity of the edge-strip sections 38, which extend in the longitudinal direction of the web 4 between the tabs 37, no chip material is available and no support is provided. It turns out, however, that the intermittent support in the notched edge of the web 4 renders possible sufficient thermal transfer in the edge zone.

I claim:

1. A method for continuously manufacturing wood chip boards and similar board materials composed of particles bonded by a binder, which together form a main filling cured under heat and pressure in a double-belt press having a pressing zone formed between a metal bottom belt for forming the bottom surface of the board material and a metal top belt for forming the top surface of the board material, and a support structure for pressing the belts together wherein the bottom and top metal forming belts rotate in opposite direction to carry particles fed into the double-belt press through the pressing zone, said method comprising the steps of:

a. spreading the main filling on a horizontal portion of the bottom forming belt;

b. intermittently vacuuming off longitudinal sections of the edges of the main filling, leaving tabs in place; and c. transmitting the necessary heat and pressure from the support structure through the bottom and top forming belts to cure the main filling and form a web from which the board materials are made by compressing the main filling, with the tabs, between the support structure and the bottom and top forming belts.

2. The method of claim 1 wherein the length of the sections that are vacuumed off is between approximately 30 and 100 cm.

3. The method of claim 1 wherein each of the sections that are vacuumed off has a width of between approximately 2 and 30 cm.

4. The method of claim 3 wherein the length of the sections that are vacuumed off is between approximately 30 and 100 cm.

5. The method of claim 1 wherein each of the tabs has a length of between approximately 2 and 20 cm.

6. The method of claim 5 wherein the length of the sections that are vacuumed off is between approximately 30 and 100 cm.

7. The method of claim 5 wherein the ratio of the length of the sections that are vacuumed off to the length of the tabs is between approximately 3:1 and 15:1.

8. The method of claim 7 wherein the length of the sections that are vacuumed off is between approximately 30 and 100 cm.

9. A double belt press for the continuous manufacture of wood chip boards and similar board materials composed of particles bonded by a binder, which together are cured under heat pressure in the press to form the board materials, said press comprising:

a. a top metal, rotatable belt for forming a top surface of the board material;

b. a bottom, metal rotatable belt for forming a bottom surface of the board material, said bottom belt being disposed beneath said top belt to form a pressing zone therebetween in which a pourable material may be conducted for forming a web from which the board materials are made, said bottom belt being adapted to carry the pourable material into the pressing zone;

c. means for spreading a main filling of particles and binder onto a horizontal portion of the bottom belt; and d. means for intermittently vacuuming narrow sections of the main filling from the edges of the main filling.

* * * * *